US005888450A

United States Patent [19]

Finkl et al.

[11] Patent Number: 5,888,450

[45] Date of Patent: Mar. 30, 1999

[54] FINE GRAINED DUCTILE PLASTIC INJECTION MOLDS FORGING TOOLS AND MACHINE COMPONENTS AND ALLOY STEEL THEREFOR HAVING A TITANIUM NITRIDE PINNED AUSTENITIC GRAIN STRUCTURE

[75] Inventors: Charles W. Finkl; Algirdas A. Underys, both of Chicago, Ill.

[73] Assignee: A. Finkl & Sons Co., Chicago, Ill.

[21] Appl. No.: 883,483

[22] Filed: Jun. 26, 1997

Related U.S. Application Data

[63] Continuation-in-part of Ser. No. 446,892, May 17, 1995, abandoned, which is a continuation-in-part of Ser. No. 222,412, Apr. 4, 1994, Pat. No. 5,496,516.

[51] Int. Cl.[6] ..... C22C 38/44; C22C 38/50

[52] U.S. Cl. ..... 420/109; 148/335

[58] Field of Search ..... 420/109; 148/335

[56] References Cited

U.S. PATENT DOCUMENTS 4,318,739 3/1982 Lehman ..... 420/109

*Primary Examiner*—Deborah Yee
*Attorney, Agent, or Firm*—James G. Staples

[57] ABSTRACT

Fabricated components, such as plastic injection molds, forging tools and machine components formed from a fine grained, low phosphorus, high hardness, high wear resistance, high hardenability, good machineability and high polishability, low alloy steel which is suitable for applications at elevated temperatures and at room temperatures, and an alloy steel having the following composition,

| | |
|---|---|
| C | .45–.60 |
| Mn | .75–.95 |
| P | .017 max |
| S | .025 max |
| Si | .15–.35 |
| Ni | .60–2.00 |
| Cr | .85–1.30 |
| Mo | .40–.85 |
| V | 0–.30 |
| Al | 0–.030 |
| Ti | .003–.020 |
| $N_2$ | 40–90 ppm |

the S, V and Al all being present in at least a small but effective amount, said steel and fabricated parts made therefrom being characterized by austenite grain boundaries being pinned with titanium nitrides.

9 Claims, 4 Drawing Sheets

Fig. 1.
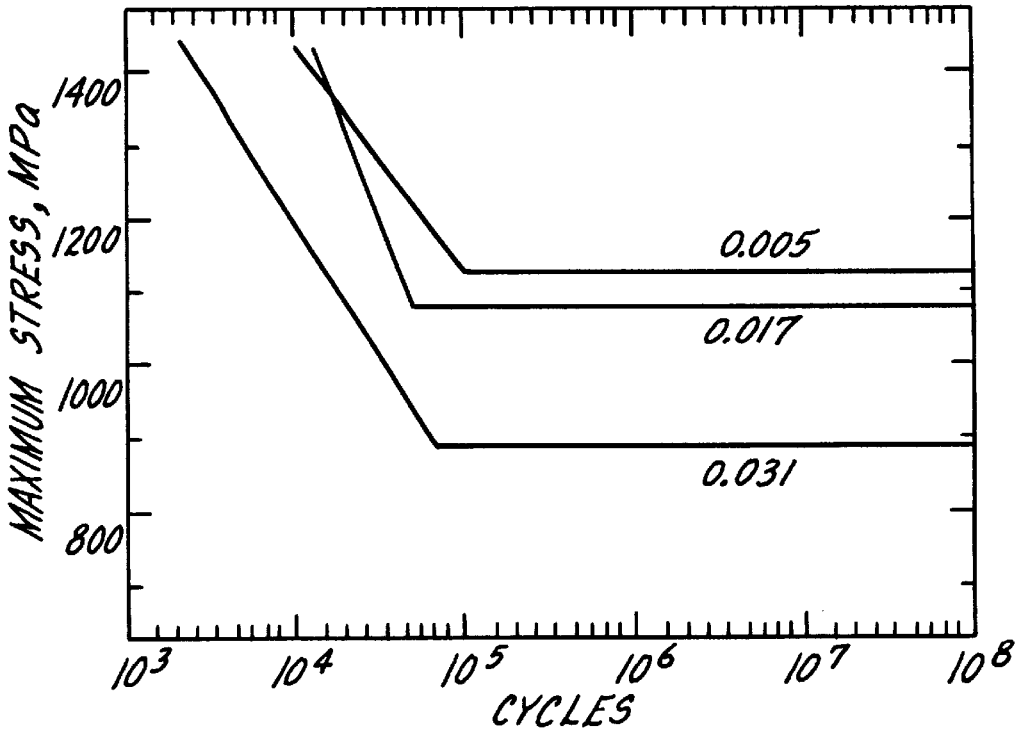
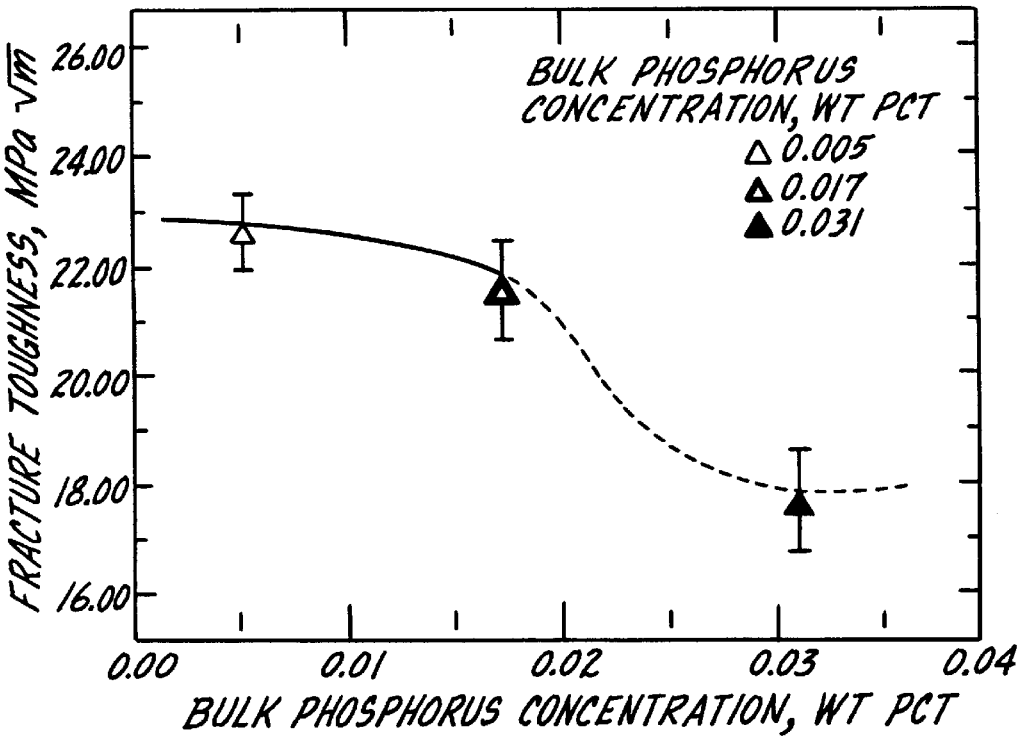
Fig. 2.

Fig. 3.
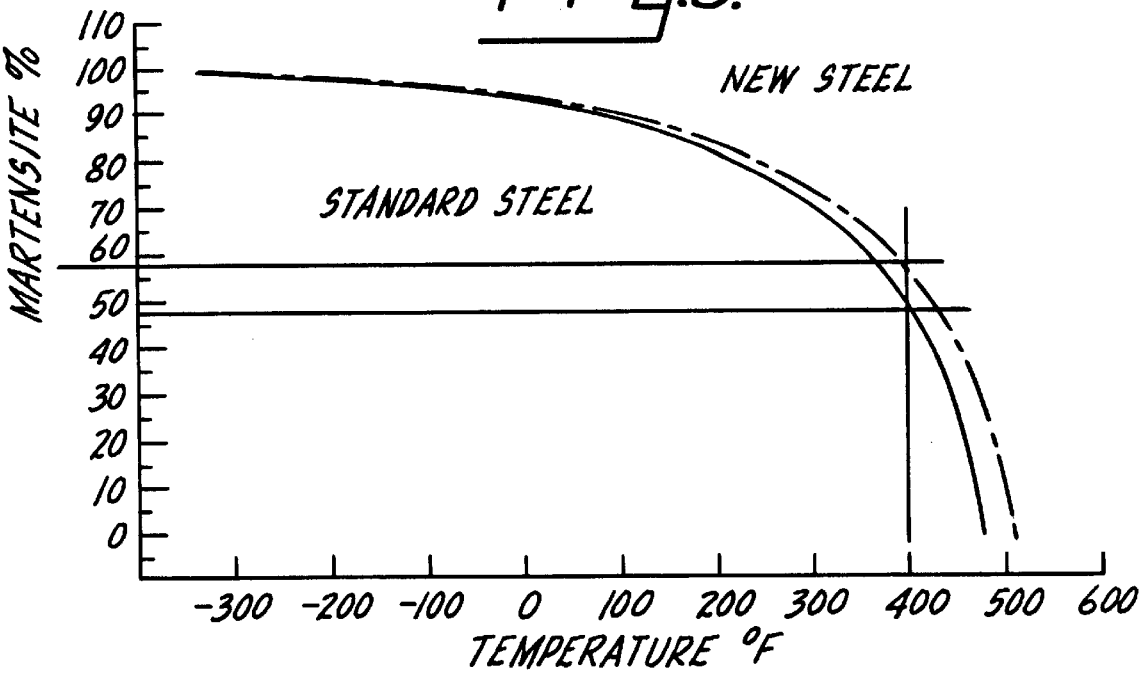
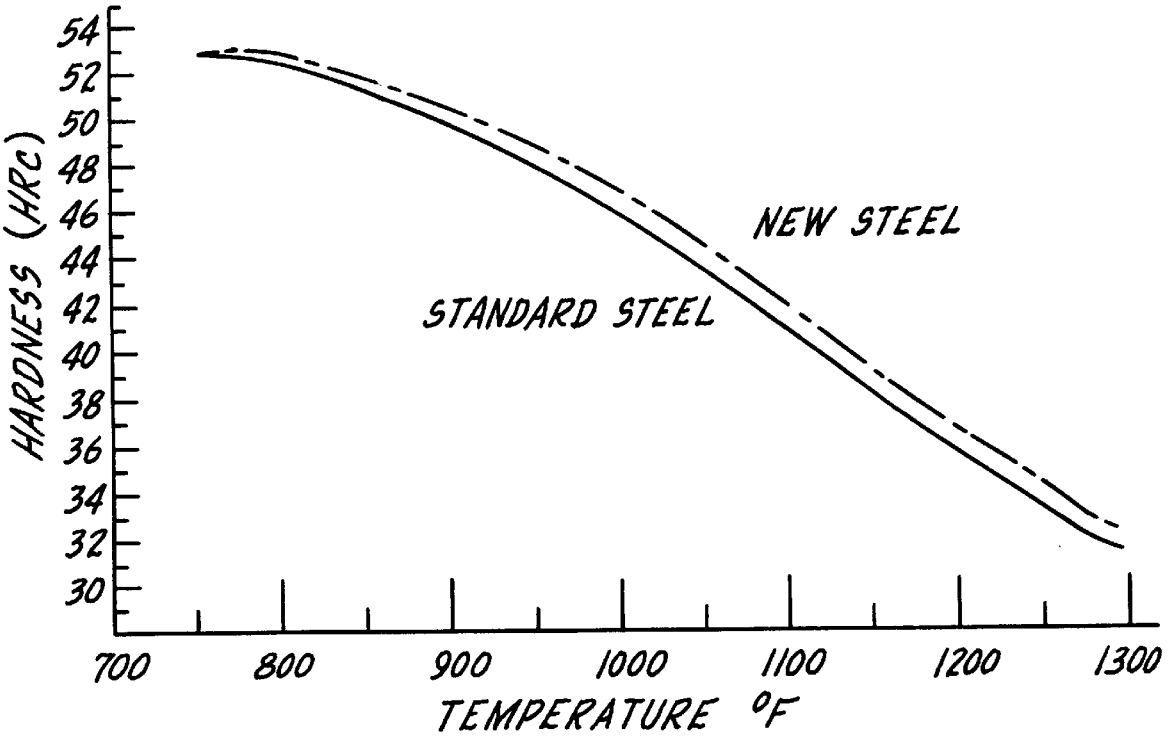
Fig. 4.

Fig. 5.
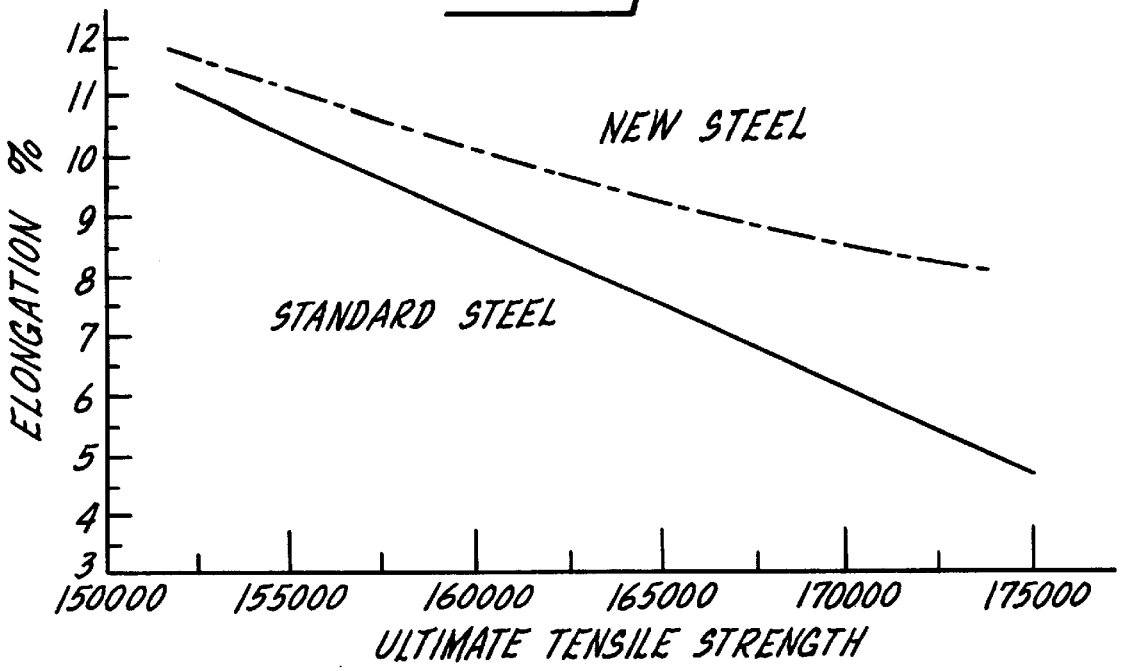
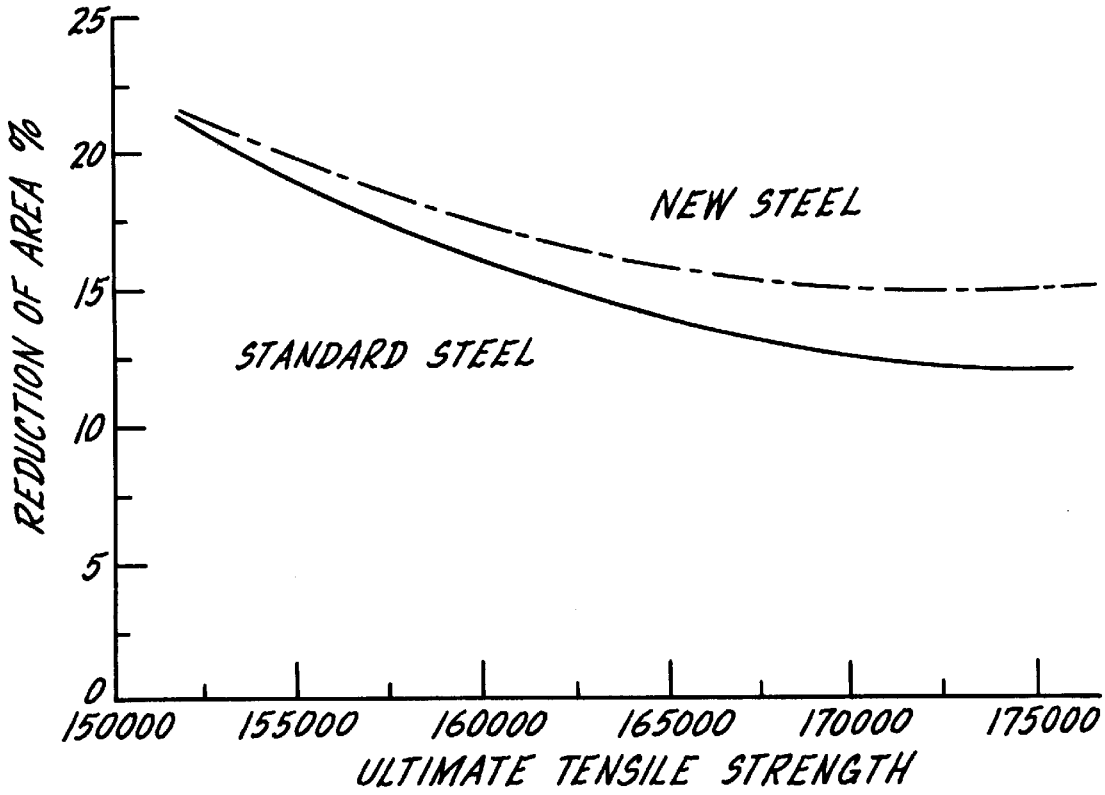
Fig. 6.

FINE GRAINED DUCTILE PLASTIC INJECTION MOLDS FORGING TOOLS AND MACHINE COMPONENTS AND ALLOY STEEL THEREFOR HAVING A TITANIUM NITRIDE PINNED AUSTENITIC GRAIN STRUCTURE

This application is a continuation in part of application Ser. No. 08/446,892, filed May 17, 1995, now abandoned which application in turn is a continuation-in-part of application ser. No. 08/222,412, filed Apr. 4, 1994, now U.S. Pat. No. 5,496,516.

This invention relates to fine grained, ductile, plastic injection molds, forging tools and machine components, and alloy steel therefor, the austenite grain boundaries of which are pinned with titanium nitrides. It relates specifically to such components and composition in which, firstly, an aluminum deoxidized steel has fine grain structure, 5 or better, and in which the austenite grain boundaries are pinned by titanium nitrides and, secondly, excellent fatigue and fracture resistance is maintained over the complete range of intended applications; i.e.: from plastic injection molds to semi-finished or fully finished machinery components, (such as gear teeth), to die blocks which are used in hot forging operations, said applications being carried out under elevated temperature or room temperature conditions as appropriate. However, in all applications the component or composition possesses high fatigue and fracture resistance, high strength, high hardness, high wear resistance, a fine grained structure with titanium nitride pinned austenite grain boundaries and a concomitant ability to take and hold a high polish finish, and excellent through hardness.

BACKGROUND OF THE INVENTION

In the current increasingly competitive economic environment the steelmaker must provide a product which is capable of satisfactory usage in more than one application to remain competitive in the marketplace. However, this economic dictate poses substantial challenges to the skill of the steelmaker since the operating conditions in two applications are often different and consequently the required physical and chemical characteristics are dissimilar or even in conflict.

If the steel is to be used as a mold, such as a plastic injection mold where the tool's ability to take and hold a smooth surface during long production runs is important, polishability along with high wear resistance, high hardenability, and easy machineability are key requirements. However, high strength and ductility are not as critical as the aforementioned attributes and hence the steelmaker can favor enhancement of the above mentioned key operating requirements over such attributes as high strength and ductility.

If a steel is to be used as a closed die forging tool, for example, high strength, high wear resistance, high hardenability and easy machining are essential. Fatigue resistance is not an especially critical characteristic in closed die forging since a typical die block may only be subjected to, for example, 5,000–10,000 cycles per sinking during its useful life expectancy of, for example, six or eight resinks. As a consequence the steelmaker whose product is intended to be used in closed die forging can favor enhancement of the required operating characteristics of this application such as wear resistance, impact resistance and through hardenability, over ductility and polishability, as by using alloys which contribute to the required characteristics but which do not significantly enhance ductility, and thus fatigue resistance or polishability.

If the steelmaker wishes to apply the same steel to machine part applications, such requirements as high strength, high wear resistance, high through hardness and easy machining are still important, but, in addition, ductility, and consequently fatigue resistance, must be increased since machine parts, such as gear teeth, run millions of cycles. Resistance to fracture is, generally, of lesser importance in machine parts since such parts generally are not subjected to sudden, heavy shock loads of the type encountered in closed die forging and hence the steelmaker, theoretically, can conserve on elements which contribute to fracture resistance. By the same token, the ability to take and hold a high polish is not an essential characteristic.

Thus, though high hardness, high wear resistance and through hardening are required in all applications, and said characteristics along with high strength are essential in both closed die forging applications and machine parts, polishability, fatigue resistance and fracture resistance requirements differ from environment to environment, and thus the steelmaker is faced with the task of providing a single steel which is usable in distinctly different operating environments without loading the steel with alloys which would cause the cost of the steel to the user to be so high as to be uneconomical.

SUMMARY OF THE INVENTION

The invention consists of several fabricated components all formed from an aluminum deoxidized steel having a titanium nitride pinned austenitic grain structure suitable for elevated and room temperature operating conditions having excellent polishability, high fatigue resistance, high fracture resistance, a fine grain derived from close control of the deoxidizing elements aluminum and titanium, and, also, close control of phosphorus, said invention being equally adaptable to the unique demands of the molding industry, and particularly the plastic injection mold industry, and, also, to the rugged demands of the closed die forging industry, and the different yet equally demanding requirements of the machine parts industry, said invention requiring only modest amounts of alloying constituents; i.e.: less than 7%, and being therefore economical to produce by the manufacturer and easy to use by the consumer. Inherent in the foregoing is that the aluminum deoxidized steel and components made therefrom, in addition to having high polishability and excellent fatigue resistance and fracture resistance properties, also has high strength, high hardness, high wear resistance, excellent through hardness, good machinability and, especially, prior austenite grain boundaries which are pinned with titanium nitrides.

A basic tenet of metallurgy is that the best physical properties of a steel are obtained when the heat treated structure of the material is tempered martensite and is fine grained. Therefore, to improve the ductility of a material the amount of martensite that is created during the quenching process must be maximized. Since the steel of this invention is currently drastically quenched to achieve its physical properties ductility cannot be improved by modifying heat treatment parameters. Applicant discovered however that the amount of martensite transformed during the heat treatment process can be increased and the grain size could be refined by modifying the chemistry.

Set out below are the broad and preferred ranges of the composition of the fabricated parts and the steel of this invention.

| | Broad | Intermediate | Preferred |
|---|---|---|---|
| C | .45–.60 | .45–.53 | .45–.51 |
| Mn | .75–.95 | .75–.95 | .75–.95 |
| P | .001–.017 | .001–.012 | .001–.005 |
| S | .025x | .025x | .025x |
| Si | .15–.35 | .15–.35 | .15–.35 |
| Ni | .60–2.00 | .80–1.40 | .80–1.10 |
| Cr | .85–1.30 | 1.00–1.30 | 1.00–1.30 |
| Mo | .40–.85 | .40–.64 | .40–.64 |
| V | 0–.30 | .04–.10 | .04–.10 |
| Al | 0–.030 | 0.015–.025 | .015–.025 |
| Ti | .003–.020 | .004–.014 | .004–.014 |
| $N_2$ | 40–90 ppm | 40–90 ppm | 40–90 ppm |

BRIEF DESCRIPTION OF THE DRAWING

Important features of the invention are illustrated in the accompanying drawing in which FIG. 1 is a comparison of maximum stress v. number of cycles for steels containing, respectively, 0.005, 0.017 and 0.031 weight percent phosphorous;

FIG. 2 is a plot of average fracture toughness as a function of bulk phosphorous content in said three steels;

FIG. 3 is a comparison of martensite transformation temperatures of a steel of this invention as compared to a standard steel;

FIG. 4 is a comparison of tempering response curves of a steel of this invention as compared to a standard steel;

FIG. 5 is a comparison of the elongation of a steel of this invention as-compared to a standard steel;

FIG. 6 is a comparison of the reduction in area of a steel of this invention as compared to a standard steel.

DETAILED DESCRIPTION OF THE INVENTION

Figure 7:
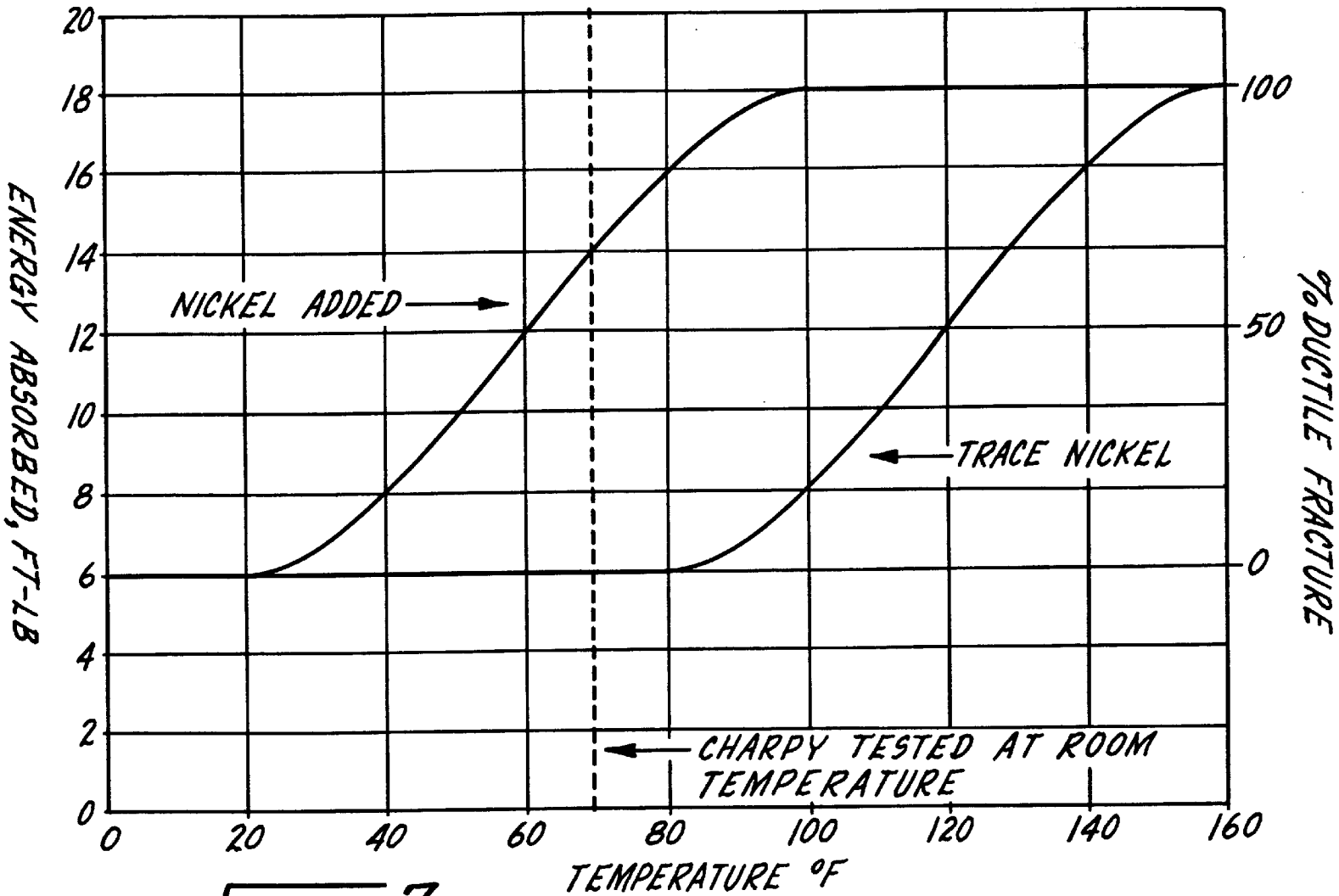
FIG. 7 is a concept curve which illustrates the dramatic shift in the FATT curve which results when a small but effective amount of Ni is added as contrasted to the absence, or only a trace, of Ni.

Carbon, in increasing amounts, lowers the temperature that transformation to martensite begins. However, as the temperature is lowered, an increased amount of less desirable transformation products, such bainite and pearlite, are formed. From the broad perspective of the objectives to be attained however carbon, a potent alloy, should be lowered to improve ductility, and hence carbon should be present in the range of 0.45–0.60 and can be tolerated in the range of 0.45–0.53. Decreasing the carbon content has a disadvantageous effect however in that carbon is essential to provide the necessary strength and hardness for hot working application of the steel in closed die forging. Carbon also greatly influences the hardenability, that is, how deeply hardness will penetrate a given cross-section. Therefore, lowered carbon must somehow be compensated for if satisfactory performance in closed die forging applications is to be maintained while at the same time providing a product having high room temperature ductility which is essential for machine part applications. If such compensation can be achieved, carbon in the range of 0.45–0.51 can be tolerated.

Manganese, a good deoxidizer, should be present in the range of 0.75–0.95. Decreasing manganese below the indicated level will increase the possibility of red shortness caused by sulphur. Also, decreasing manganese will detract from the hardenabilty of the steel. Increasing the manganese content above the indicated level will lower the transformation temperature of martensite, thereby decreasing ductility.

Phosphorus is an important element whose contribution to the desired properties has not heretofore been fully appreciated.

Phosphorous is of particular importance with respect to the endurance limit and fracture toughness of the steel. Phosphorus segregates during austentizing heat treatments and appears to stimulate the formation of cementite, and thus the precipitation of carbon to the grain boundaries during quenching. Further, the degree of phosphorus segregation is dependent on the phosphorus and carbon content of the steel. When too much phosphorus segregation, and accompanying carbon precipitation, occurs, a point is reached at which fatigue resistance and fracture resistance are so seriously affected that the steel's usefulness as a dual purpose closed die forging implement or a machine part is compromised to an unacceptable extent. In tests on a similar low alloy steel and specifically a slightly modified 4320 steel which differed solely in the phosphorus content, the results shown in FIG. 1 were obtained on specimens having 0.005, 0.017 and 0.031 phosphorus respectively. The curves show that endurance limits decreased with an increase in phosphorus content and, further, that the fatigue life was quite similar in the 0.005 and 0.017 specimens, but significantly lower in the 0.031 specimens.

In fracture toughness tests on specimens of said three variations the results shown in FIG. 2 were obtained which clearly indicate that phosphorus lowers the fracture resistance. Again, the rests for the 0.005 and 0.017 phosphorus steels have similar toughness characteristics, with the 0.005 phosphorus steel being somewhat better, but with the 0.031 phosphorus steel being considerably lower.

It should be noted that phosphorus also has a major effect on the microstructure and properties of such alloy steel. The following table shows that there is a strong affinity of phosphorus and carbon to co-segregate to austenite grain boundaries as indicated by a simultaneous increase of intergranular phosphorus and carbon with increasing bulk phosphorus concentrations.

| P (Wt Pct) | Percent Retained Austenite (25 $\mu$m) | Endurance Limit (MPa) | Average Fracture Toughness (MPa $\sqrt{m}$) | Intergranular Phosphorus Concentration (25 $\mu$m) | Intergranular Carbon Concentration (25 $\mu$m) |
|---|---|---|---|---|---|
| 0.005 | 29.8 | 1125 | 23 | 0.7 at. pct | 20.6 at. pct |
| 0.017 | 25.3 | 1075 | 22 | 0.9 at. pct | 21.4 at. pct |
| 0.031 | 18.7 | 875 | 18 | 1.6 at. pct | 23.7 at. pct |

It will be noted that the stronger said interaction, the lower are the fatigue and fracture resistance, again with little difference between the 0.005 phosphorus and the 0.017 phosphorus, with the 0.005 phosphorus being somewhat better, but with a significant difference between the 0.005/0.017 phosphorus on the one hand and the 0.031 phosphorus on the other hand.

It should be noted that with increasing phosphorus content the solubility of carbon in austenite decreases, and therefore, as the steel's phosphorus content increases and concentrations of phosphorus build up at the austenite grain boundaries, the formation of cementite is enhanced and the solubility of carbon in equilibrium with the cementite decreases. As a consequence, the more complete the coverage of the grain boundaries by the cementite, the lower the fatigue and fracture resistance.

From the foregoing it can be seen that increasing the steel's phosphorus content causes increased segregation of phosphorous and carbon at the grain boundaries with the carbon in the form of intergranular cementite. Further, with increasing phosphorus comes lower fatigue and lower fracture resistance, two properties which must be at a high level for closed die forging and machine part applications. In terms of magnitude, the fatigue resistance and fracture resistance of steels decreases slightly from 0.005 phosphorus to 0.017 phosphorus but decreases sharply in steel containing 0.031 phosphorus.

It will be appreciated, however, that although a final phosphorus content of 0.005 is attainable on small melts, this low level is very difficult to achieve at the present time in high volume electric furnace steelmaking. However, control of phosphorus has consistently improved over the past few years to the point where phosphorus values of 0.012 can be consistently achieved in large tonnage production, and further work toward attainment of lower phosphorus levels continues. Thus, although 0.005 is an ideal toward which research efforts are directed, 0.012 represents a realistic achievable level for the efficient, technically progressive, large tonnage electric furnace steelmaker at the present time.

Lower sulphur levels would improve the ductility of the steel. Sulphur, however, is required to maintain the easy machinability of the steel. A small but effective quantity of sulphur must be present, but the upper sulphur level preferably should be maintained below 0.025% maximum.

Silicon should be maintained in the range of 0.15 to 0.35. Silicon is an important element in this composition due to its deoxidation capability. Titanium has a high affinity for oxygen and can be used to deoxidize a melt through the formation of titanium oxides. These titanium oxides, however, act as inclusions that are detrimental to the physical properties and polishability. The melt must be thoroughly deoxidized before any titanium is added to achieve the maximum benefit of the titanium. A minimum level of silicon of 0.15 assures that the melt is deoxidized before any additions of titanium can be made, and hence silicon must not be reduced below the above level. Increased levels of silicon in amounts greater than the range specified can affect the solidification behavior of the steel, possibly resulting in ingot flaws such as primary and secondary pipe.

Nickel should be maintained in the range of 0.60 to 2.00% for its contribution to toughness, hardenability, and improved resistance to heat checking. At low temperatures, a material may exhibit a ductile mode. At intermediate temperatures, this same material will exhibit a brittle mode of failure under impact forces. At elevated temperatures, this same material will exhibit a combination of both types of failure. This temperature at which the material changes from being brittle to being ductile is called the fracture appearance transition temperature (FATT). Die steels should be preheated above the FATT temperature in order to avoid brittle failure under impact loads. If the FATT curve can be shifted to lower temperatures, the brittle failures due to inadequate preheating can be minimized. Nickel is used for its ability to shift the fracture transition temperature i.e., the transition from brittle to ductile mode. A minimum nickel concentration of 0.60 percent is necessary to avoid catastrophic die breakage due to inadequate preheating. FIG. 7 dramatically illustrates the shift of the FATT curve as represented by (a) the trace nickel curve on the right side of the graph of FIG. 7 which shows that a pre-heat temperature of at least 160° F. is required, and (b) the nickel added curve on the left side of FIG. 7 which shows that no pre-heat, or only about 30°, is required to produce the same impact resistance. Increased nickel concentrations, however, increase the amount of retained austenite in steel. If the retained austenite decomposes to untempered martensite in a die steel during use as a forging die, a hard, brittle phase may develop that can lead to catastrophic die failure. Nickel is also one of the most costly alloys and should therefore be limited to the above range in order to make the steel, and fabricated parts made therefrom, price competitive.

While Ni up to 2.00 is acceptable, quite adequate results have been attained in compositions having Ni in the range of 0.80 to 1.40. Indeed, acceptable results are obtained when Ni is present in an amount no greater than 1.1%.

Chromium is increased by an amount which is significant in these specialized applications and should be present in the range of 0.85–1.30 or, preferably, in the range of 1.00–1.30. The chromium offsets the decrease in hardenability due to the modest carbon content of this steel without affecting the positive attributes of the material. It is believed that the additional amount of chromium increases the wear resistance of the material through the increased formation of chromium carbides.

Molybdenum should be present in the range of 0.40–0.85. Molybdenum increases the hardenability of the steel while reducing the possibility of temper embrittlement. Molybdenum is a strong carbide former that improves wear resistance. It is however a relatively expensive alloy and, assuming conformance to the other ranges herein described and conventional heat treatment, molybdenum in the range of 0.40–0.64 will provide satisfactory results.

Vanadium must be present in a small but effective amount up to 0.30, but preferably in the range of 0.04–0.10%. Vanadium has three major effects. Vanadium is an important element for its effect on increasing hardenability. Vanadium also increases the wear resistance through the formation of vanadium carbides. Vanadium also is used to promote fine grain size through the same mechanism of prior austenite grain pinning as does titanium. However, excessive quantities of vanadium are detrimental to the ductility through the formation of an increased quantity of coarse carbides, and hence it is best to work at about 0.10 max.

Aluminum and titanium must be considered together and, further, as will be apparent hereinafter, titanium must, in turn, be considered in light of the quantity of nitrogen present in this type of steel. In other words, there is a definite relationship between aluminum, titanium and nitrogen, and this relationship is a key factor in the desirable attributes of the fabricated parts and composition of this invention.

Aluminum is the deoxidizer of choice for producing a fine grain structure in this type of Cr-Ni-Mo-V low alloy steel.

The use of too much aluminum can however result in excessive inclusions and hence aluminum must be present in a small but effective amount up to 0.030. However, to ensure a fine grain structure at moderate operating temperatures and, equally importantly, considering the presence of titanium, the preferred range of aluminum is 0.015–0.025.

Titanium is also a deoxidizer, though it is a less potent deoxidizer than aluminum. However, titanium has the unique characteristic that when it is added as an alloying element to an aluminum deoxidized steel (ignoring for the moment the potential disadvantages of titanium), fine grain characteristics are attained.

Thus, in closed die forging and plastic injection molding operations, it is essential that a combination of aluminum and titanium be present to ensure that a fine grain structure is obtained. The amount of titanium which should be present has been found, in turn, to be dependent on the amount of nitrogen present, as will be apparent from the following.

Titanium forms titanium nitrides, titanium carbides and titanium carbo-nitrides, all of said compounds being to some degree stable at elevated operating temperatures of, for example, approximately 2150° F. Of these compounds, titanium nitrides are especially suitable for pinning austenite grain boundaries. Now, the stoichiometric ratio of titanium to nitrogen is 3.4 to 1 in weight percent. However, the grain boundary pinning characteristics of titanium nitrides is most effective when the TiN has a hyperstoichiometric composition rather than a stoichiometric composition; see for example, *The Effects of Composition and Hot Working Parameters on the Mechanical Properties of Microalloyed Pearlitic and Martensitic Forging Steels*, Lee et al, Microalloyed Bar and Forging Steels, p. 20, 1996. For the purpose of grain pinning in the instant steel, the ratio of titanium to nitrogen in the range of 2.3 parts, or less, of titanium to 1 part of nitrogen by weight is more effective for grain boundary pinning than the stoichiometric ratio.

Now, the great bulk of steel which is processed by an electric furnace followed by vacuum degassing and arc heating under vacuum (which is the preferred form of processing the steel composition of this invention; see U.S. Pat. No. 3,236,635 and 3,501,289 the disclosures of which are incorporated herein by reference) have an $N_2$ content of 40 ppm to 90 ppm; indeed, in one study nearly all of the study heats of this invention had an $N_2$ content in the aforesaid range.

As a consequence, in order to ensure that the ratio of titanium to nitrogen is 2.3 or less in steels having 40–90 ppm $N_2$, titanium must be present in the range of a small but effective amount up to 0.009 weight percent. However since an average $N_2$ content of 65 ppm $N_2$ can be expected, maintenance of the 2.3 to 1 ratio results in the presence of titanium in an amount up to 0.014 weight percent in the presence of aluminum. Thus, to summarize:

The aluminum, silicon, and manganese level of the disclosed steel is sufficient to completely deoxidize the molten metal, but these elements alone do not ensure toughness and ductility. Specifically, refinement of grain size is a significant factor in improving toughness and ductility. In this regard, titanium, as a grain refiner, is more effective when added to aluminum deoxidized steels as contrasted to non-aluminum deoxidized steels. Titanium forms nitrides, carbides, and carbonitrides in steel that are stable at elevated temperatures (approximately 2150° F.). Of these three components, titanium nitrides are especially suitable for pinning austenite grain boundaries. The stoichiometric ratio of titanium to nitrogen is 3.4 to 1 in weight percent. However, the ratio of titanium to nitrogen in the range of 2.3 parts or less of titanium to 1 part nitrogen by weight is more effective for grain boundary pinning.

The solubility of nitrogen in steel is affected by the chemical composition of the melt and by processing parameters. The range of nitrogen content of the instant steel processed as described in U.S. Pat. Nos. 3,236,635 and 3,501,289 is typically between 40 and 90 ppm (0.004 to 0.009 weight percent) with an average of 65 ppm (0.0065 weight percent). Therefore the ideal maximum level of titanium would be 0.009 weight percent to ensure that the titanium to nitrogen weight ratio is no more than 2.3 to 1. Higher titanium levels lead to the formation of coarse titanium nitride, titanium carbide, and titanium carbo-nitride particles that precipitate at higher temperatures and are less effective for grain size control. Titanium carbide crystals tend to be large and blocky in appearance. Titanium carbide precipitates are apt to produce objectionable pitting of finely ground or polished surfaces such as plastic injection molds. In forging applications, these pits can act as stress risers that lead to premature heat checking. In machinery parts and plastic injection mold applications, this pitting can be unacceptable for aesthetic or functional reasons. While titanium levels up to 0.020 can be tolerated in high nitrogen heats, the preferred titanium range is 0.004 to 0.014, given the above 40ppm-90ppm range of nitrogen, to minimize the formation of coarse precipitates and ensure grain refinement in heats of the described steel with typical nitrogen levels after vacuum arc degassing processing.

The martensite transformation temperatures of the steel of this invention which has been processed by vacuum arc degassing have been calculated and compared to the transformation temperature of a comparable steel which has been used in closed die forging applications and which has anominal composition of C. 50–60; Mn. 75–0.95; S usual; P usual; Si 0.15–0.35; Cr 0.85–1.15; Ni 0.60 –2.00; Mo 0.25–0.55; V 0.0–0.30; Al 0.015–0.030; and Ti 0.003–0.0075. The values can be found in the graph in FIG. 3. As can be seen from the graph the martensite start temperature is raised (martensite 0% temperature), as well as the amount of martensite that would be formed at temperatures typically encountered at the end of the quench process. The graph indicates that there is an increased amount of austenite transformed to martensite, which after tempering, increases the ductility of the material. For example, the projecting lines from an end quench temperature of 400° F. show approximately 60% martensite transformation in the new steel as contrasted to only about 50% transformation in the reference steel which is approximately a 20% increase.

To determine if the chemistry change would have any effect on the heat treatment of the material or the resistance to softening of the material when used as a die, a tempering response curve is presented in FIG. 4. As can be seen from FIG. 4 the chemistry increases slightly the resistance to tempering of the material. This is a beneficial result in that, in die applications, die failure occasionally occurs due to overheating, and subsequent softening of the die. The soft die then wears out prematurely.

Heats of the new chemistry were cast. The chemical compositions of two of the heats are set out in the following table. Test blocks (10"×10"×12") were forged and heat treated from each heat.

| | Heat 1 | Heat 2 |
|---|---|---|
| C | 0.50 | .52 |
| Mn | .87 | .89 |
| P | .009 | .006 |
| S | .015 | .018 |
| Si | .30 | .30 |
| Ni | .94 | .98 |
| Cr | 1.16 | 1.16 |
| Mo | .47 | .49 |
| V | .05 | .05 |
| Al | 0.022 | 0.22 |
| Ti | .015 | .010 |
| $N_2$ | 65 ppm | 59 ppm |

The surface and center of the test blocks were measured. The center hardness of the test blocks were, after averaging, less than one Rockwell number greater than the standard chemistry (37.6 versus 37HRc). This increase in center hardness, at the same tempering temperature, is a slight improvement over the standard chemistry, and verifies that the chemistry modification was not detrimental to the hardenability of the material, a result which might have been expected.

Transverse tensile samples were obtained from the center of the test blocks. The center location was chosen because it is the location and direction in which it is most difficult to achieve adequate physical properties in a forging. The center location is frequently the location of the highest stress concentration in a die block due to the geometry, location, and depth of the die impression.

The test data clearly show an increase in the ductility of the new steel versus the standard steel. The information representing the increase in elongation can be found in FIG. 5 from which it will be noted that at a UTS of 170,000, the elongation increased from about 5% to about 8½%, or an increase in comparative terms of approximately 70%.

The improvement in reduction of area can be seen in FIG. 6 from which it will be noted that at 170,000 UTS the reduction in area increased from about 12½% to about 16%, or an increase in comparative terms of approximately 28%.

Eight additional heats of this steel of this invention were cast, forged, heat treated and put into service as closed die forging parts or machine parts, all with satisfactory results.

| | 3 | 4 | 5 | 6 | 7 | 8 | 9 | 10 |
|---|---|---|---|---|---|---|---|---|
| C | .50 | .50 | .49 | .49 | .49 | .48 | .51 | .52 |
| Mn | .88 | .82 | .91 | .86 | .90 | .81 | .85 | .86 |
| P | .009 | .008 | .008 | .008 | .010 | .009 | .010 | .011 |
| S | .019 | .017 | .021 | .017 | .021 | .011 | .014 | .019 |
| Si | .25 | .28 | .23 | .27 | .26 | .25 | .24 | .26 |
| Ni | 1.04 | .93 | 1.02 | .93 | .91 | .93 | .94 | .91 |
| Cr | 1.19 | 1.15 | 1.09 | 1.19 | 1.16 | 1.08 | 1.18 | 1.21 |
| Mo | .52 | .46 | .53 | .44 | .43 | .44 | .44 | .43 |
| V | .053 | .040 | .048 | .056 | .050 | .052 | .057 | .046 |
| Al | .023 | .022 | .020 | .019 | .023 | .019 | .012 | .020 |
| Ti | .009 | .008 | .011 | .009 | .008 | .011 | .012 | .013 |
| $N_2$ | 57 | 54 | 57 | 60 | 63 | 60 | 54 | 65 |

The improvement made by the new steel as contrasted to the earlier described reference steel can be seen from the following comparison of die failures, cracking or wear, reported by users of the reference composition and the new composition to the producer.

| Calendar Quarter No. | Reference Steel | This Steel |
|---|---|---|
| 1 | 6 | — |
| 2 | 4 | — |
| 3 | 3 | — |
| 4 | 4 | 0 |
| 5 | 3 | 0 |
| 6 | 1 | 0 |
| 7 | 1 | 1 |
| 8 | 2 | 1 |
| Average failures/quarter | 2.57 | .4 |

As can be readily appreciated the new steel has significantly decreased the number of reported die failures by users; indeed, the new steel decreased the failure incident rate by more than 50% or, indeed by more than 80% when the per quarter rate of the new steel is compared to the three calendar quarters in which the new steel had not been released by the producer for use by customers.

The foregoing closed die forging parts results plus equally satisfactory service as machine parts shows that no matter what the type of fabricated part application, the new steel gives significantly improved performance even though the chemical constituents may be quite similar to known steels.

Although a preferred embodiment of the invention has been illustrated and described, it will at once be apparent to those skilled in the art that various modifications and changes may be made within the spirit and scope of the invention be limited solely by the hereafter appended claims when interpreted in light of the relevant prior art, and not by the foregoing exemplary description.

I claim:

1. A balanced aluminum-titanium-nitrogen steel having minimal intergranular cementite characterized by having a maximum bulk phosphorous content of no more than 0.017 weight percent, a maximum stoichiometric ratio of titanium to nitrogen of 3.4 to 1 in weight percent,

| | Min. | Max. |
|---|---|---|
| C | .45 | .60 |
| Mn | .75 | .95 |
| S | | .025 max |
| Si | .15 | .35 |
| Ni | .60 | 2.00 |
| Cr | .85 | 1.30 |
| Mo | .40 | .85 |
| V | .0 | .30 |
| Al | .015 | .025 |
| Ti | .003 | .020 |
| $N_2$ | 40 ppm | 90 ppm |
| Fe | balance | |

the intergranular grain boundaries having a titanium nitride pinned austenitic grain structure, said steel having high polishability, excellent fatigue resistance, excellent fracture resistance, excellent through hardness and good machinability.

2. The balanced aluminum-titanium-nitrogen steel of claim 1 characterized in that said steel has a bulk phosphorous content of no more than 0.012 weight percent.

3. The balanced aluminum-titanium-nitrogen steel of claim 1 characterized in that said steel has a bulk phosphorous content of no more than 0.005 weight percent.

4. The balanced aluminum-titanium-nitrogen steel of claim 1 characterized in that said steel has a maximum stoichiometric ratio of titanium to nitrogen of 2.3 to 1 in weight percent.

5. The balanced aluminum-titanium-nitrogen steel of claim 2 characterized in that said steel has a maximum stoichiometric ratio of titanium to nitrogen of 2.3 to 1 in weight percent.

6. The balanced aluminum-titanium-nitrogen steel of claim 3 characterized in that said steel has a maximum stoichiometric ratio of 2.3 to 1 in weight percent.

7. The balanced aluminum-titanium-nitrogen steel of any preceding claim wherein

| | Min. | Max. |
|---|---|---|
| C | .45 | .43 |
| Mn | .75 | .95 |
| S | | .025 max. |
| Si | .15 | .35 |
| Ni | .80 | 1.40 |
| Cr | 1.00 | 1.30 |
| Mo | .40 | .64 |
| V | .04 | .10 |
| Al | .015 | .025 |
| Ti | .004 | .014 |
| Ni | 40 ppm | 90 ppm |
| Fe | balance | |

8. The balanced aluminum-titanium-nitrogen steel of any preceding claim wherein

| | Min. | Max. |
|---|---|---|
| C | .45 | .51 |
| Mn | .75 | .95 |
| S | | .025 max. |
| Si | .15 | .35 |
| Ni | .80 | 1.10 |
| Cr | 1.00 | 1.30 |
| Mo | .40 | .64 |
| V | .04 | .10 |
| Al | .015 | .025 |
| Ti | .004 | .014 |
| $N_2$ | 40 ppm | 90 ppm |
| Fe | balance | |

9. An article made from the composition of any preceding claim.

* * * * *

UNITED STATES PATENT AND TRADEMARK OFFICE

CERTIFICATE OF CORRECTION

PATENT NO. : 5,888,450

DATED : March 30, 1999

INVENTOR(S) : Charles W. Finkl; Algirdas A. Underys

It is certified that error appears in the above-identified patent and that said Letters Patent is hereby corrected as shown below:

Column 10, line 50, that portion of the line reading ".015 .025" should read --up to .030--

In column 11, line 15, that portion of the line reading ".43" should read --.53--

Signed and Sealed this

Seventh Day of September, 1999

*Attest:*

Q. TODD DICKINSON

*Attesting Officer*

*Acting Commissioner of Patents and Trademarks*